US005469016A

United States Patent [19]

Chun

[11] Patent Number: 5,469,016

[45] Date of Patent: Nov. 21, 1995

[54] P-F CONNECTOR STRUCTURE FOR A CATHODE-RAY TUBE

[75] Inventor: Se-Ki Chun, Gumi-Shi, Rep. of Korea

[73] Assignee: Orion Electric Co., Ltd., Kyungsangbuk-Do, Rep. of Korea

[21] Appl. No.: 149,218

[22] Filed: Nov. 5, 1993

[51] Int. Cl.[6] ..... H01J 29/02

[52] U.S. Cl. ..... 313/402; 313/404; 313/407

[58] Field of Search ..... 313/402, 404, 313/407, 408, 482

[56] References Cited

U.S. PATENT DOCUMENTS 3,377,493 4/1968 Levin et al. ..... 313/92
4,128,790 12/1978 Steeghs ..... 313/408
5,126,624 6/1992 Ji ..... 313/402

*Primary Examiner*—Donald J. Yusko
*Assistant Examiner*—Michael Day
*Attorney, Agent, or Firm*—Beaton & Folsom

[57] ABSTRACT

A P-F connector establishing electrical connection between a conducting layer formed on the inside wall of the funnel and a fluorescent layer formed on the inside wall of the panel is disclosed.

The P-F connector comprises a fixed portion having a through hole; the first connecting portion extended from one side of said fixed portion and bent, to be electrically connected to said conducting layer; and the second connecting portion extended from the same side of said fixed portion and bent in the opposite direction from said first connecting portion to be electrically connected to said fluorescent layer.

1 Claim, 4 Drawing Sheets

P-F CONNECTOR STRUCTURE FOR A CATHODE-RAY TUBE

BACKGROUND OF THE INVENTION

1. Field of the Invention

This invention relates to a P-F(Panel-Funnel) connector structure installed in a cathode-ray tube, and more particularly, to the P-F connector for a cathode-lay tube establishing electrical connection between a conducting layer formed on the inside wall of the funnel and a fluorescent layer formed on the inside wall of the panel.

2. Information Disclosure Statement

Generally, a cathode-ray tube consists of a neck having on electron gun mount assembly and a body having a viewing screen. The body has a panel and a funnel. The conducting layer is formed on the inside wall of the funnel and the fluorescent layer is formed on the inside wall of the panel. The funnel has an anode terminal to which a high voltage is applied. The fluorescent layer inside the panel should be electrically connected to the conducting layer inside the funnel.

The connector is mounted on a mask frame so that the fluorescent layer in the Panel is electrically connected to the conducting layer in the funnel. The connector is so called a P-F connector. Also, a frame holder is welded to the mask frame, one end of the frame holder mounted a holder pin. The conducting layer on the lower portion of the holder pin is coated so that the fluorescent layer of the panel can be connected to the frame holder. The conducting layer on the lower portion of the holder pin is manually coated by a paint-brush. Hence, the high voltage applied to the anode terminal is transmitted to the fluorescent layer of the panel by way of the conducting layer of the funnel, the P-F connector, the mask frame, the frame holder and the conducting layer on the lower portion of the holder pin.

The prior art applying the high voltage of the anode terminal to the fluorescent layer of the panel reduces the conductivity of the fluorescent layer, thereby deteriorating the quality of the viewing screen. Also, because the conducting layer on the lower portion of the holder pin is manually coated by the paint-brush, the fabrication process of the cathode-ray tube is complicated.

Therefore, it is an object of the present invention to provide a P-F connector structure for the cathode-ray tube so that the fluorescent layer of the panel is connected directly to the conducting layer of the funnel.

It is another object of the present invention to simplify the fabrication process of the cathode-ray tube by excluding the coating process of the conducting layer on the lower portion of the holder pin.

The above function is only one of the various, useful features of the invention. The invention can achieve other advantages when applied in a different manner or modified within the scope of the disclosure. The summary of the invention and the detailed description of the invention below describe the preferred embodiment of the invention within the scope of its claims.

SUMMARY OF THE INVENTION

To achieve the above-mentioned purposes, a P-F connector establishing electrical connection between a conductor layer formed on the inside wall of the funnel and a fluorescent layer formed on the inside wall of the panel comprises a fixed portion having a through hole; the first connecting portion which is extended from one side of the fixed portion, bent, and electrically connected to the conducting layer and the second connecting portion extended from the same side of the fixed portion, bent in the opposite direction from the first connecting portion, and electrically connected to the fluorescent layer.

The pertinent and important features of the present invention have been outlined above in order to provide a better understanding of the invention. Additional features of the invention described hereinafter further elaborate the claims of the invention. Those skilled in the art can appreciate that the conception and the specific embodiment disclosed herein may be readily utilized as a basis for modifying its structures to carry out the same purpose of the present invention. Furthermore, those skilled in the art can realize that such equivalent constructions do not depart from the spirit and scope of the invention as set forth in the claims.

BRIEF DESCRIPTION OF THE DRAWINGS

To better understand the nature and object of the invention, reference should be made to the following detailed description taken in conjunction with the accompanying drawings in which.

DETAILED DESCRIPTION OF THE INVENTION

Figure 1:
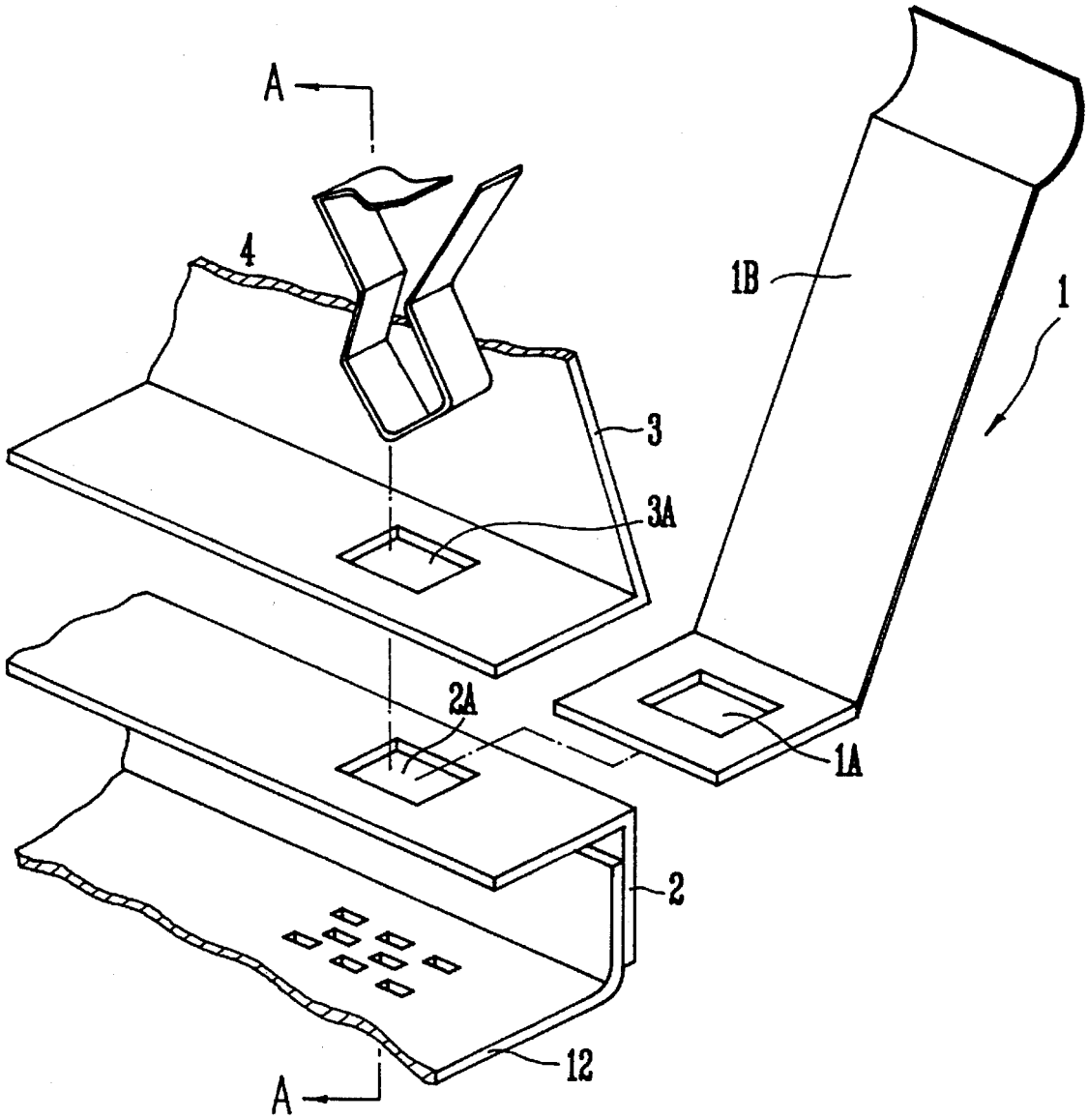
FIG.1 (PRIOR ART)
FIG. 1 is an exploded perspective view of an embodiment of the prior art.

FIG. 1 is an exploded perspective view of an embodiment of the prior art.

As shown in FIG. 1, a shadow mask 12 is welded to a mask frame 2 having the first through hole 2A. The P-F connector 1 having the second through hole 1A and a connecting portion 1B is inserted between the mask frame 2 and the inner shield 3 having the third through hole 3A. A fixed pin 4 is inserted into the third through hole 3A, the second through hole 1A and the first through hole 2A, thereby combining the P-F connector 1, the mask frame 2 and the inner shield 3 together.

Figure 2:
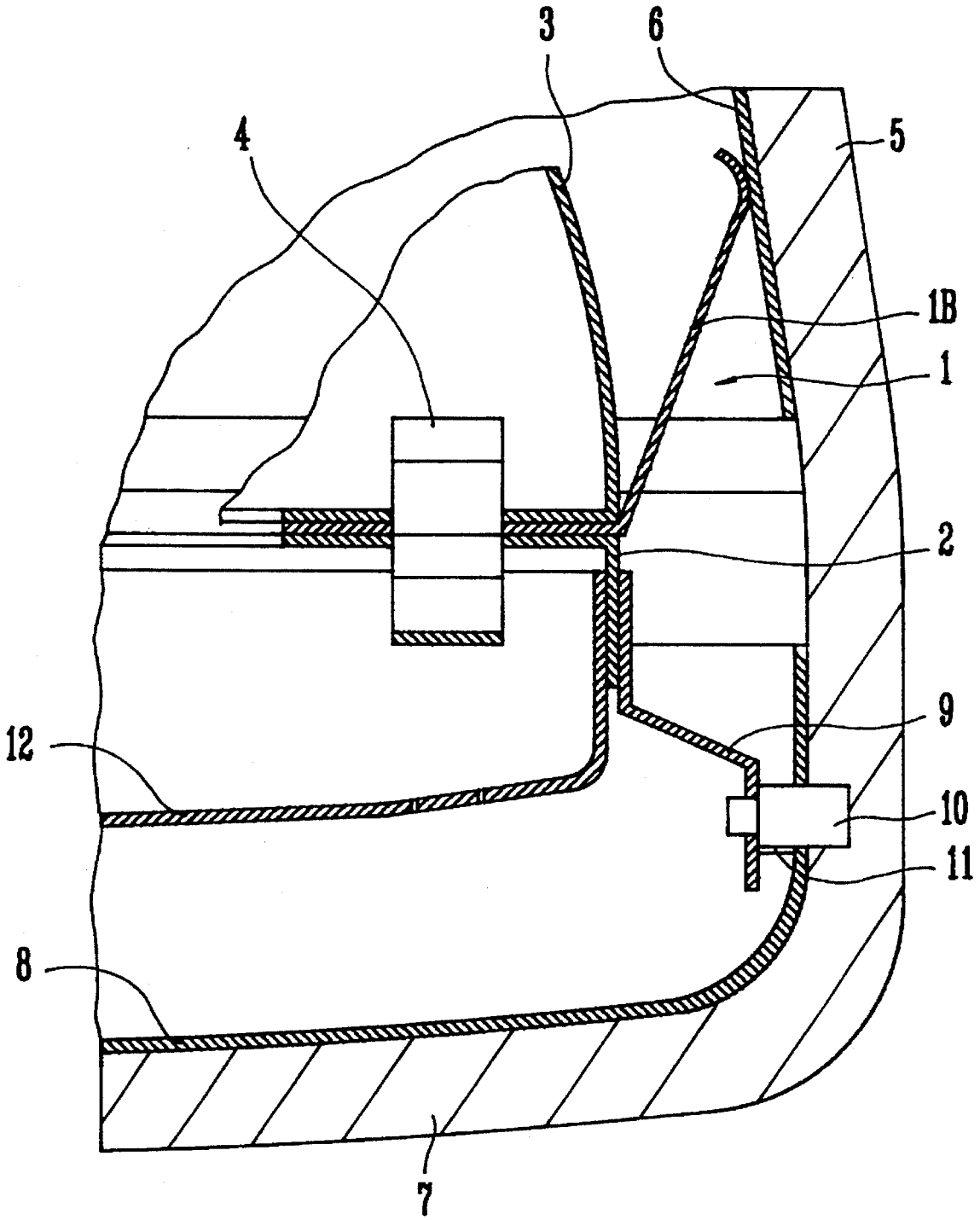
FIG.2 (PRIOR ART)
FIG. 2 is a sectional view, partly in cross-section of an embodiment of the prior art.

FIG. 2 is a sectional view, partly in cross-section of the prior art.

A sectional view taken along the line A—A of the FIG. 1 is included in FIG. 2.

As shown in FIG. 2, the first conducting layer 6 is formed on the inside wall of the funnel 5, and the connecting portion 1B of the P-F connector 1 is electrically connected to the first conducting layer 6.

Also a fluorescent layer 8 is formed on the inside wall of the panel 7 and on the lower portion of the funnel 5, and a holder pin 10 is mounted on the lower portion, on which the fluorescent layer 8 is formed.

One side portion of the frame holder 9 is welded to the mask frame 2, and another side portion thereof is fixed to the holder pin 10. To establish electrical connection between the frame holder 9 and the fluorescent layer 8, the second conducting layer 11 is made by coating the lower portion of the holder pin 10.

Hence, the high voltage applied to an anode terminal(not shown) is transmitted to the fluorescent layer 8 by way of the connecting portion 1B of the P-F connector 1, the mask frame 2, the frame holder 9 and the second conducting layer 11.

Figure 3:
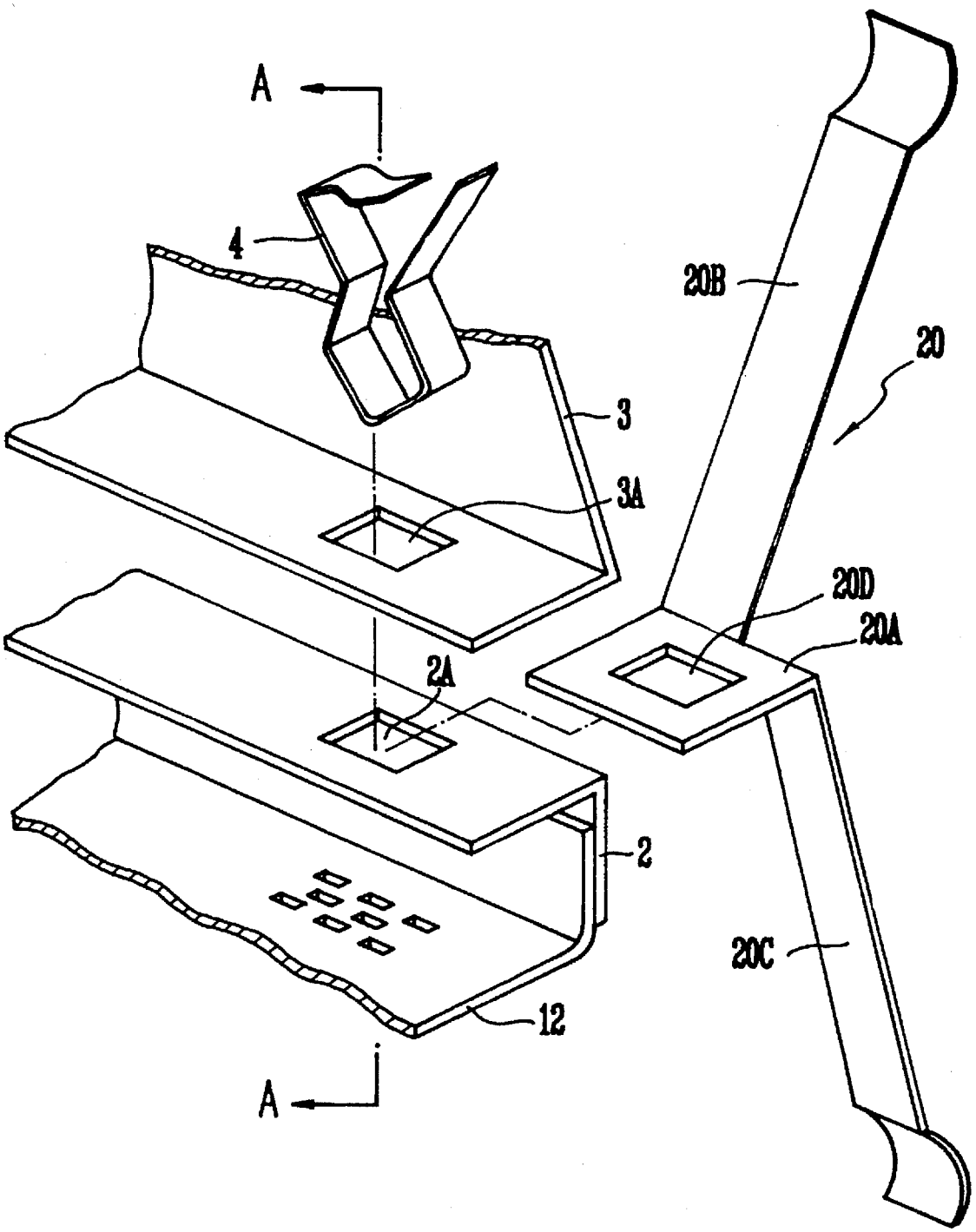
FIG. 3 is an exploded perspective view of an embodiment of the present invention.

FIG. 3 is an exploded perspective view of an embodiment of the present invention.

The construction of FIG. 3 is identical to that of FIG. 1 except the feature of the P-F connector.

As shown in FIG. 3, a P-F conductor 20 is inserted between the inner shield 3 and the mask frame 2, and comprises a fixed portion 20A having the third through hole 20D, the first connecting portion 20B bent to a desired degree and extended from one side of the fixed portion 20A, and the second connecting portion 20C bent in the opposite direction from the first connecting portion 20B, extended from the same side of the fixed portion 20A.

Figure 4:
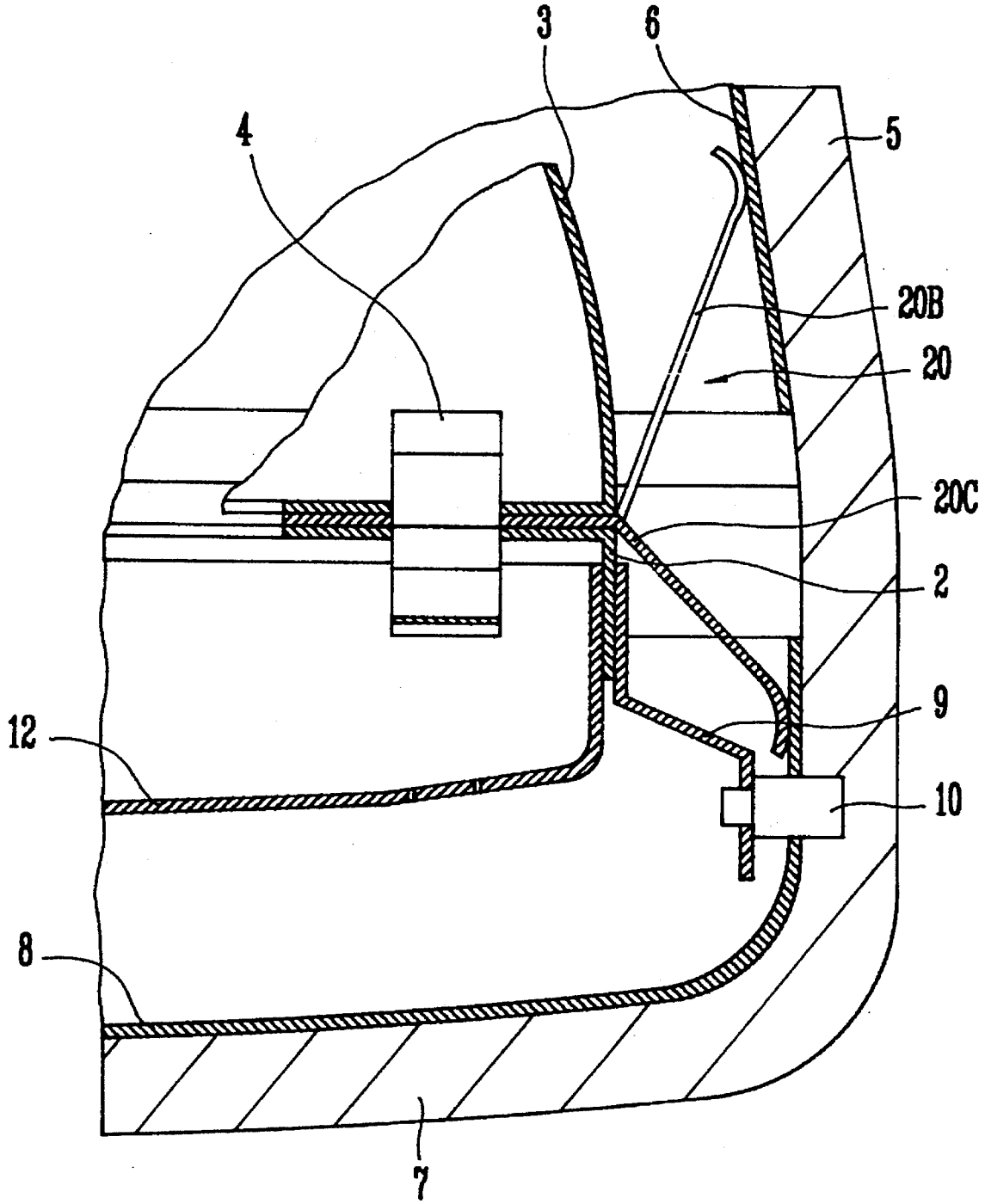
FIG. 4 is a sectional view, partly in cross-section of an embodiment of the present invention.

FIG. 4 is a sectional view, partly in cross-section of an embodiment of the present invention.

A sectional view taken along the line A—A of the FIG. 3 is included in FIG. 4.

As shown in FIG. 4A, one end of the first connecting portion 20B of the P-F connector 20 is electrically connected to the first conducting layer 6, and the second connecting portion 20C thereof is electrically connected to the fluorescent layer 8. Thus the high voltage applied to an anode terminal(not shown) is transmitted to the fluorescent layer 8 through only the P-F connector 20 i.e., the first connecting portion 20B and the second connecting portion 20C.

However, the fluorescent layer 8 can be easily scratched, and the conductivity between the second connecting portion 20C and the fluorescent layer 8 decreases if the fluorescent layer 8 is scratched by the second connecting portion 20C.

The second connecting portion 20C, therefore should be made thin and smooth in order not to scratch the fluorescent layer 8.

Therefore, the present invention makes the process of making cathode-ray tubes simple by fixing the inner shield to the mask frame with a pin instead of welding and by saving the coating process of the conducting layer for the electrical connection of the fluorescent layer and the frame holder.

What is claimed is:

1. A P-F connector comprising:

a fixed portion formed at an end of said P-F connector and located between a mask and an inner shield, thereby fixing to the mask and the inner shield by a clip and through holes formed on the fixed portion, the mask and the inner shield respectively; and a connecting portion formed at another end of said P-F connector and electrically connecting a funnel and a panel, said connecting portion including (i) a first connecting portion connected to a conducting layer of an inside wall of the funnel and (ii) a second connecting portion connected to a fluorescent layer of an inside wall of the panel; wherein said connecting portion is divided into said first and second connecting portions in a longitudinal direction and said first and second connecting portions are bent in opposite directions relative to each other.

* * * * *

UNITED STATES PATENT AND TRADEMARK OFFICE

CERTIFICATE OF CORRECTION

PATENT NO. : 5,469,016

DATED : November 21, 1995

INVENTOR(S) : Chun

It is certified that error appears in the above-indentified patent and that said Letters Patent is hereby corrected as shown below:

At Column 1, line 9: replace "cathode-lay tube" with--cathode-ray tube--

At Column 1, line 14: replace "a neck having on" with--a neck having an--

At Column 3, line 11: replace "P-F conductor 20" with--P-F connector 20--

At Column 3, line 23: replace "As shown in FIG. 4A" with--As shown in FIG. 4--

Signed and Sealed this

Twenty-fifth Day of June, 1996

Bruce Lehman

*Attest:*

BRUCE LEHMAN

*Attesting Officer*

*Commissioner of Patents and Trademarks*